US009339836B2

(12) United States Patent
Sheiman

(10) Patent No.: US 9,339,836 B2
(45) Date of Patent: May 17, 2016

(54) ULTRASONIC ATOMIZATION APPARATUS

(75) Inventor: Vladimir Lvovich Sheiman, Rosebery (AU)

(73) Assignee: BIOSONIC AUSTRALIA PTY LTD, Rosebery, NSW (AU)

( * ) Notice: Subject to any disclaimer, the term of this patent is extended or adjusted under 35 U.S.C. 154(b) by 935 days.

(21) Appl. No.: 12/301,624

(22) PCT Filed: May 22, 2006

(86) PCT No.: PCT/AU2006/000677

§ 371 (c)(1),
(2), (4) Date: Nov. 20, 2008

(87) PCT Pub. No.: WO2006/125251

PCT Pub. Date: Nov. 30, 2006

(65) Prior Publication Data

US 2009/0200397 A1 Aug. 13, 2009

(30) Foreign Application Priority Data

May 23, 2005 (AU) ..... 2005902634

(51) Int. Cl.
*B05B 1/08* (2006.01)
*B05B 3/04* (2006.01)
(Continued)

(52) U.S. Cl.
CPC ..... *B05B 17/0615* (2013.01); *B05B 12/081* (2013.01); *B05B 17/0607* (2013.01); *B05B 17/0638* (2013.01); *B05B 17/0669* (2013.01); *B05B 15/025* (2013.01)

(58) Field of Classification Search
CPC ..... B05B 17/0607; B05B 17/0638; B05B 17/0615; B05B 15/025; B05B 12/081; B05B 17/0669
USPC ..... 239/102.2, 4, 102.1, 338, 370
See application file for complete search history.

(56) References Cited

U.S. PATENT DOCUMENTS 2,027,298 A 1/1936 Wheat
2,228,009 A 1/1941 Harford
(Continued)

FOREIGN PATENT DOCUMENTS

AU 2003/254386 3/2004
AU 2006/252145 1/2007
(Continued)

OTHER PUBLICATIONS

Vecellio, L., "The mesh nebulizer: a recent technical innovation for aerosol delivery", Mar. 2006, Cover sheet & pp. 253-260, vol. 2, No. 3, Breathe.

*Primary Examiner* — Len Tran
*Assistant Examiner* — Steven M Cernoch
(74) *Attorney, Agent, or Firm* — Shapiro, Gabor and Rosenberger, PLLC

(57) ABSTRACT

The invention relates generally to a mesh type apparatus for liquid atomizing and filtration, for example, of the atomizer having a concave ultrasonic transducer, which also forms a part of the liquid container (1). This transducer is emitted an ultrasonic energy which created a spout (2) of the liquid (3) to be atomized. The liquid (8) plays a role of the transmission media. The container (9) with liquid (3) is set up on the top of the container (1). The liquid (3) is separated from the transmission media (8) through the bottom of the container (9) by a material that has minimum attenuation of ultrasonic energy. This separation could be temporary or permanent. The focal zone extender (7) is placed in the vicinity of the bottom of container (9). In this case all liquid above the bottom of the focal zone extender will be forced up to the top of the focal zone extender and atomized at the constant intensity of acoustical energy conveyed from the bottom of the focal zone extender.

13 Claims, 2 Drawing Sheets

(51) Int. Cl.

| | |
|---|---|
| ***A61M 11/06*** | (2006.01) |
| ***A61M 11/02*** | (2006.01) |
| ***B05B 17/06*** | (2006.01) |
| ***B05B 17/00*** | (2006.01) |
| ***B05B 12/08*** | (2006.01) |
| *B05B 15/02* | (2006.01) |

(56) References Cited

U.S. PATENT DOCUMENTS

| | | | | | |
|---|---|---|---|---|---|
| 2,659,042 | A | | 11/1953 | Anderson et al. | |
| 3,169,524 | A | | 2/1965 | Langevin | |
| 3,274,476 | A | | 9/1966 | Wildum | |
| 3,387,607 | A | | 6/1968 | Gauthier et al. | |
| 3,433,461 | A | | 3/1969 | Scarpa | |
| 3,472,455 | A | | 10/1969 | Johnson et al. | |
| 3,490,697 | A | | 1/1970 | Best, Jr. | |
| 3,806,100 | A | | 4/1974 | Cornett et al. | |
| 3,828,201 | A | | 8/1974 | Allen, Sr. | |
| 3,918,641 | A | | 11/1975 | Lehmann et al. | |
| 3,919,615 | A | | 11/1975 | Niecke | |
| 4,007,238 | A | | 2/1977 | Glenn | |
| 4,094,317 | A | | 6/1978 | Wasnich | |
| 4,113,809 | A | | 9/1978 | Abair et al. | |
| 4,200,093 | A | | 4/1980 | Camp | |
| 4,244,361 | A | | 1/1981 | Neubert | |
| 4,410,139 | A | * | 10/1983 | Nishikawa et al. | 239/102.2 |
| 4,533,082 | A | | 8/1985 | Maehara et al. | |
| 4,605,167 | A | * | 8/1986 | Maehara | 239/102.2 |
| 4,656,707 | A | | 4/1987 | Berte et al. | |
| 4,667,141 | A | | 5/1987 | Steele | |
| 4,689,515 | A | * | 8/1987 | Benndorf et al. | 310/316.01 |
| 4,714,078 | A | | 12/1987 | Paluch | |
| 4,792,097 | A | | 12/1988 | Kremer et al. | |
| 4,820,453 | A | | 4/1989 | Huang | |
| 4,850,534 | A | | 7/1989 | Takahashi et al. | |
| 4,902,955 | A | | 2/1990 | Manis et al. | |
| 4,951,661 | A | | 8/1990 | Sladek | |
| 4,961,885 | A | | 10/1990 | Avrahami et al. | |
| 4,976,259 | A | | 12/1990 | Higson et al. | |
| 5,062,419 | A | | 11/1991 | Rider | |
| 5,152,456 | A | * | 10/1992 | Ross et al. | 239/102.2 |
| 5,209,225 | A | | 5/1993 | Glenn | |
| 5,214,368 | A | | 5/1993 | Wells | |
| 5,226,411 | A | | 7/1993 | Levine | |
| 5,241,954 | A | | 9/1993 | Glenn | |
| 5,277,175 | A | | 1/1994 | Riggs et al. | |
| 5,297,734 | A | * | 3/1994 | Toda | 239/102.2 |
| 5,308,180 | A | | 5/1994 | Pournoor et al. | |
| 5,361,989 | A | | 11/1994 | Merchat | |
| 5,429,302 | A | | 7/1995 | Abbott | |
| 5,464,386 | A | | 11/1995 | Hofmann | |
| 5,474,059 | A | | 12/1995 | Cooper | |
| 5,485,827 | A | | 1/1996 | Zapol et al. | |
| 5,485,828 | A | * | 1/1996 | Hauser | 128/200.16 |
| 5,518,179 | A | * | 5/1996 | Humberstone et al. | 239/102.2 |
| 5,646,470 | A | | 7/1997 | de Groot | |
| 5,687,715 | A | | 11/1997 | Landis et al. | |
| 5,707,352 | A | | 1/1998 | Sekins et al. | |
| 5,724,965 | A | | 3/1998 | Handke et al. | |
| 5,741,317 | A | | 4/1998 | Ostrow | |
| 5,756,994 | A | | 5/1998 | Bajic | |
| 5,829,434 | A | | 11/1998 | Ambrosio et al. | |
| 5,865,171 | A | | 2/1999 | Cinquin | |
| 5,908,158 | A | * | 6/1999 | Cheiman | 239/102.2 |
| 5,921,232 | A | | 7/1999 | Yokoi et al. | |
| 5,983,134 | A | | 11/1999 | Ostrow | |
| 6,007,940 | A | | 12/1999 | Spotnitz | |
| 6,041,253 | A | | 3/2000 | Kost | |
| 6,106,971 | A | | 8/2000 | Spotnitz | |
| 6,152,383 | A | | 11/2000 | Chen | |
| 6,202,642 | B1 | | 3/2001 | McKinnon et al. | |
| 6,234,167 | B1 | | 5/2001 | Cox et al. | |
| 6,237,589 | B1 | | 5/2001 | Denyer et al. | |
| 6,241,162 | B1 | | 6/2001 | Takahashi | |
| 6,273,342 | B1 | | 8/2001 | Terada et al. | |
| 6,283,118 | B1 | | 9/2001 | Lu | |
| 6,328,030 | B1 | | 12/2001 | Kidwell et al. | |
| 6,357,671 | B1 | | 3/2002 | Cewers | |
| 6,379,616 | B1 | | 4/2002 | Sheiman | |
| 6,402,046 | B1 | | 6/2002 | Loser | |
| 6,443,146 | B1 | | 9/2002 | Voges | |
| 6,478,754 | B1 | | 11/2002 | Babaev | |
| 6,490,186 | B2 | | 12/2002 | Cho | |
| 6,501,197 | B1 | | 12/2002 | Cornog et al. | |
| 6,516,802 | B2 | | 2/2003 | Hansen et al. | |
| 6,530,370 | B1 | | 3/2003 | Heinonen | |
| 6,530,570 | B2 | | 3/2003 | Ku | |
| 6,550,476 | B1 | | 4/2003 | Ryder | |
| 6,554,201 | B2 | * | 4/2003 | Klimowicz et al. | 239/4 |
| 6,622,720 | B2 | | 9/2003 | Hadimioglu | |
| 6,628,798 | B2 | | 9/2003 | Teshima et al. | |
| 6,640,804 | B2 | | 11/2003 | Ivri et al. | |
| 6,651,650 | B1 | * | 11/2003 | Yamamoto et al. | 128/200.16 |
| 6,725,858 | B2 | | 4/2004 | Loescher | |
| 6,727,446 | B1 | | 4/2004 | Mayo et al. | |
| 6,851,427 | B1 | | 2/2005 | Nashed | |
| 6,854,465 | B2 | | 2/2005 | Bordewick et al. | |
| 6,863,224 | B2 | | 3/2005 | Terada et al. | |
| 6,948,491 | B2 | * | 9/2005 | Loeffler et al. | 128/200.14 |
| 7,037,306 | B2 | | 5/2006 | Podany | |
| 7,059,320 | B2 | | 6/2006 | Feiner et al. | |
| 7,080,643 | B2 | | 7/2006 | Grychowski et al. | |
| 7,089,941 | B2 | | 8/2006 | Bordewick et al. | |
| 7,179,254 | B2 | | 2/2007 | Pendekanti | |
| 7,211,320 | B1 | | 5/2007 | Cooper | |
| 8,001,962 | B2 | * | 8/2011 | Sheiman | 128/200.14 |
| 2002/0007869 | A1 | | 1/2002 | Pui et al. | |
| 2002/0011248 | A1 | | 1/2002 | Hansen et al. | |
| 2002/0082666 | A1 | | 6/2002 | Babaev | |
| 2003/0136407 | A1 | | 7/2003 | Matsuyama | |
| 2003/0140921 | A1 | | 7/2003 | Smith et al. | |
| 2003/0196660 | A1 | | 10/2003 | Haveri | |
| 2003/0205229 | A1 | | 11/2003 | Crockford et al. | |
| 2004/0025882 | A1 | | 2/2004 | Madaus et al. | |
| 2004/0119415 | A1 | | 6/2004 | Lansing et al. | |
| 2004/0267167 | A1 | | 12/2004 | Podany | |
| 2005/0010202 | A1 | | 1/2005 | Podany | |
| 2005/0042170 | A1 | | 2/2005 | Jiang et al. | |
| 2005/0215942 | A1 | | 9/2005 | Abrahamson | |
| 2006/0137680 | A1 | | 6/2006 | Sheiman | |
| 2006/0151624 | A1 | | 7/2006 | Grundler et al. | |
| 2006/0158956 | A1 | * | 7/2006 | Laugharn et al. | 366/127 |
| 2006/0163641 | A1 | | 7/2006 | Okumura | |
| 2006/0201500 | A1 | | 9/2006 | Von Hollen | |
| 2006/0201501 | A1 | | 9/2006 | Morrison et al. | |
| 2006/0201502 | A1 | | 9/2006 | Lieberman et al. | |
| 2006/0243274 | A1 | | 11/2006 | Lieberman et al. | |
| 2007/0277816 | A1 | | 12/2007 | Morrison et al. | |

FOREIGN PATENT DOCUMENTS

| | | | | | |
|---|---|---|---|---|---|
| CN | 1143528 | | | 2/1997 | |
| DE | 3434111 | | | 3/1986 | |
| DE | 3434111 | A1 | * | 3/1986 | B05B 17/06 |
| DE | 100 32 809 | | | 1/2002 | |
| JP | 54068040 | | | 5/1979 | |
| JP | 57024666 | | | 2/1982 | |
| RU | 2070062 | C1 | * | 12/1996 | A61M 11/00 |
| RU | 2076746 | | | 4/1997 | |
| WO | WO 95/26236 | | | 10/1995 | |
| WO | WO 99/42145 | | | 8/1999 | |
| WO | WO 00/23144 | | | 4/2000 | |
| WO | WO 03/035152 | | | 5/2003 | |
| WO | WO 2004/017848 | | | 3/2004 | |

* cited by examiner

ULTRASONIC ATOMIZATION APPARATUS

FIELD OF THE INVENTION

The present invention relates broadly to an atomisation apparatus and relates particularly, although not exclusively, to an atomiser for nebulizing, liquid treatment and/or filtration devices.

BACKGROUND OF THE INVENTION

There are two classes of mesh-type atomisers: vibrating mesh and static mesh.

The vibrating mesh atomisers of interest are disclosed in, for example, U.S. Pat. Nos. 4,533,082 and 5,152,456. They produce a stream of liquid droplets by vibrating a perforate membrane (mesh) having its inner face in contact with liquid so that droplets are expelled from holes in the membrane at each cycle of vibration. The size of droplets produced depends on the holes' size. The membrane is activated by a vibrating means connected to the housing of the device. Atomisers of this type require the means to deliver liquid to the mesh and include an additional device for vibrating the mesh. These vibrating mesh atomisers have problems with clogging and disinfection.

Static mesh nebulizers apply a force on the liquid to push it through a static mesh. In early models the liquid was supply by means of a pressure pump or the like. The U.S. Pat. No. 6,651,650 described this type of atomiser. The device has ultrasonic nebulisation mechanism including piezoelectric element, a step horn and a mesh. The bottom part of the step horn is in contact with the liquid to be atomized. This liquid is delivered to the mesh through the hole in the step horn, which functions as an ultrasonic pump. The liquid to be atomized is emitted out of the holes in the mesh toward the aerosol-emitting outlet. The mesh deterioration due to clogging, e.g. by suspension particles, is a cause of concern for both vibrating and static mesh atomisers. Other problems with this prior art include: low delivery rate and limited volume, which restricts this technology mainly to the medical applications. The majority of mesh-type atomisers require supply mechanisms to deliver liquid from container to the mesh. Also, all mesh-type atomisers pose significant difficulties with cleaning and disinfection.

SUMMARY OF THE INVENTION

According to the present invention there is provided an atomisation apparatus comprising:

- a container being adapted to hold a liquid to be atomized;
- an acoustical oscillator being operatively coupled to the container for transmission of acoustical energy to the liquid;
- oscillating means being operatively coupled to the acoustical oscillator and arranged to cause said oscillator to oscillate; and
- a mesh disposed adjacent the container for contact with the liquid which at least in part passes through the mesh and is atomized.

Preferably the apparatus increases efficiency of the aerosol delivery rates in order to allow this technology to be used in industrial applications, including water filtration.

Preferably the apparatus minimizes or prevents the mesh clogging.

Preferably the apparatus provides a simplified design atomiser requiring no specific driving means for delivering the liquid to the mesh.

Preferably the apparatus provides a regular self-cleaning effect to the mesh.

Preferably the apparatus is of an improved design to allow easy disinfection of the mesh.

Preferably the apparatus provides increased efficiency due to dual atomisation mechanisms (in the spout and through the mesh).

DETAILED DESCRIPTION OF THE INVENTION

Figure 1:
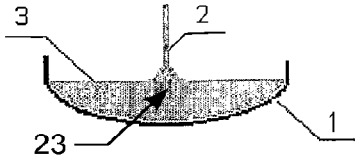
FIG. 1 shows a prior art device having a spout produced by focusing the ultrasonic energy.

To solve many of the above described problems it is desirable to provide the liquid to be atomized with enough acoustical energy so as, alongside with atomisation, to perform cleaning and disinfection. The successful design should not employ capillary conduits on the way of liquid from the container to the mesh. The device should be able to maintain acoustical pressure at the liquid-mesh interface on a designated level. The mesh should be easily movable to allow for its cleaning and disinfection.

The current invention in the preferred embodiment presents a new concept of mesh-type atomisation that delivers on all of these objectives. The concept employs the liquid to be atomized as the principal transmission/carrier medium allowing the acoustical energy to concentrate on or towards the mesh. Thus, being highly energized, liquid here takes over many useful functions, which in prior art required additional dedicated sub-systems. Still, the liquid's main function is to serve as an integral part of the focusing system that eliminates a need for a particular solid acoustical concentrator and thus reduces the losses and increases the efficiency of the atomisation. This concept may utilize any existing type of technology that performs focusing of ultrasound, resulting in a spout formation, but preferably one using a concave ultrasonic transducer.

Thus, placing the mesh in the vicinity of the focal zone is the main idea of at least an embodiment of the present invention. The idea immediately presents a lot of opportunities to control the atomisation process, such as: regulating the mesh position above or below the focal zone, keeping the liquid level above or below the focal zone, etc. Combining these new opportunities with the existing ones, such as e.g. ultrasound intensity, results in our ability to stabilize thresholds and other atomisation parameters that, in turn, results in elimination of unwanted effects of e.g. clogging, or dropping of the liquid level, etc.

It is important to understand the difference between the purely ultrasonic atomisation and the mesh-type one. In the mesh-type atomisers the particle sizes depend mainly on the mesh holes aperture. In ultrasonic atomisers the particle sizes depend mainly on the ultrasonic frequency because the aerosol is produced by explosion of cavitation bubbles caused by the standing wave occurring on the liquid-air interface. In general, various embodiments of the present invention can produce a variable, controllable mixture of the two types of aerosol. In cases when the mesh-type aerosol is preferable, the mesh position relative to the focal zone plays important role. Because the cavitation bubbles have high impedance to acoustical energy the mesh should be fitted in the part of spout where the aerosol due to the cavitation bubbles is not created. If both types of atomisation are required the first should be ultrasonic atomisation. In this case non-atomized part of the spout should be directed to the mesh for further atomisation.

All of the preceding is illustrated in the FIGS. 1-9 in details.

Figure 2:
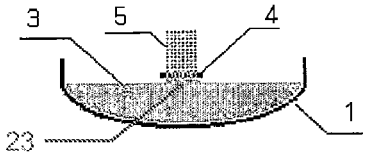
FIG. 2 shows a mesh obstructing a liquid spout in accordance with an embodiment of the present invention.

FIG. 1 is the known prior art design comprising a concave ultrasonic transducer 1 (which also forms a part of the liquid container which designated by the same number 1 as well) emitting ultrasound creating a spout 2 of the liquid 3 to be atomized at relatively low radiation power. When the mesh 4 is placed into the spout 2, a very dense fog 5 gets emitted from the top surface of the mesh (FIG. 2). If ultrasound intensity is above the threshold of the aerosol production, the mesh 4, enclosed in a girdle 6 and dipped below the level of the liquid, can still produce aerosol (FIG. 3).

There may be some advantages in placing the mesh above the focal zone 23. This is achieved by using a feature, which may be described as a focal zone extender 7 (FIG. 4) designed in a form of a cylinder, cone or other shape. It should be made of a rigid material, with high acoustical impedance (e.g. metal, ceramics etc). In this case the ultrasonic energy will be transmitted to the top of the focal zone extender thus shifting the focal zone in this new position.

The liquid container 1 (FIG. 5) may be filled to the full with levels high above the focal zone and the extender's entrance (inlet opening at the lower end of the extender), without any adverse effect on aerosol production. The pressure of the initial column of liquid inside the extender is negligible, and the device operates similarly to the mode of FIG. 4. Under the large acoustical pressure created in the focal zone, the liquid, which is above the entrance in the focal zone extender, will be pumped up from the bottom to the top of the focal zone extender.

Figure 3:
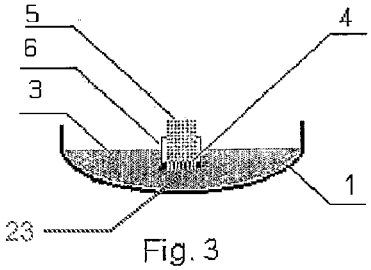
FIG. 3 shows the mesh in FIG. 2, coupled with a tubular girdle, dipped below the surface of the liquid to be atomized.
Figure 4:
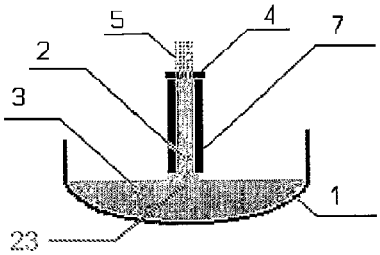
FIG. 4 shows the spout as in FIG. 2 entering a "focal zone extender"

It was found that devices in FIGS. 2-4 have a residual mass of the liquid to be atomized. The residual mass is due to the reduction of energy under the focal point. It occurs because the level of the atomized liquid is decreased during atomisation, and space between the focal point and the surface of the atomized liquid is raised. As known, the intensity of the acoustic energy is decreased with increasing the distance from the focal point. Thus, when the level of the acoustical energy is less than the atomisation threshold, the process of aerosol production will stop and non-atomized liquid will reside in the container.

Figure 6:
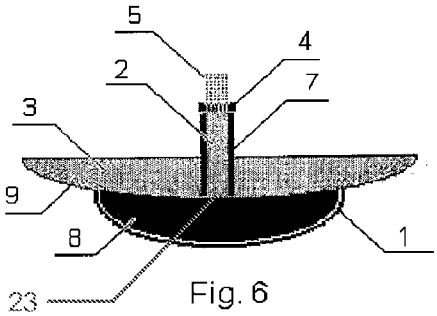
FIG. 6 is a two-compartment type holder of the liquid to be atomized.
Figure 10:
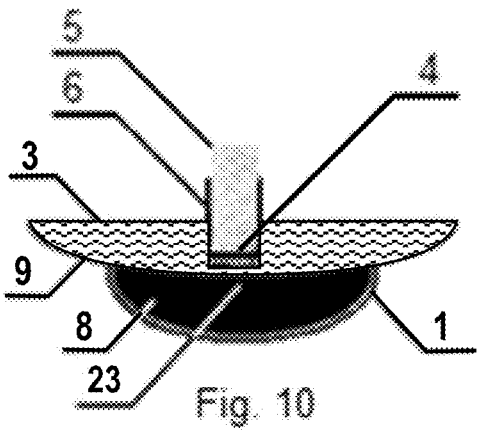
FIG. 10 is another two-compartment type holder for the liquid to be atomized.

To eliminate the residual mass it is required to maintain the constant level of the acoustical energy on the surface of the mesh for all amount of the liquid to be atomized. This can be realized with a two-compartment type holder. In the first compartment the transmission media 8 should be placed (FIG. 6 and FIG. 10). If the transmission media is liquid it should be separated from the liquid to be atomized by a material that has minimum attenuation of ultrasonic energy for instance a thin plastic film. Separation can be carried out in any form: permanent or disposable, including a disposable capsule, which can be placed on the top of transmission media. On the top of the transparent material the liquid to be atomized is poured and held in the second compartment 9. The separating material will be the common part of both compartments.

The level of the acoustic energy on the bottom of the compartment with the liquid to be atomized has to be enough for successful atomisation and close as much as possible to the level of energy in the focal point.

Figure 5:
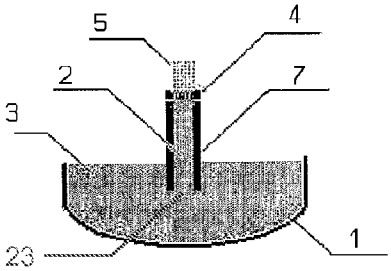
FIG. 5 shows the FIG. 4 design with the liquid level topped up above the focal point.

Using a concept analogous to FIG. 5 one should place the lower part of the focal zone extender in the vicinity of the bottom of the compartment with the liquid to be atomized. In this case all liquid above the bottom of the focal zone extender will be forced up to the top of the focal zone extender and atomized at the constant intensity of acoustical energy conveyed from the bottom of the focal zone extender. It is due the fact that, on the bottom of the focal zone extender, the intensity of acoustical energy will depend on the geometry of the focus system, but not on the level of liquid above the bottom of the focal zone extender.

Thus the focal zone extender can very successfully solve the problem of minimization of the liquid residual. In this conception the mesh 4 should be positioned on the top of, or in the vicinity of the top of the focal zone extender as shown in FIG. 6.

This design, which exploits the focal zone extender, can be very useful for all atomisers, which utilize a method of atomisation in a spout. If the intensity of the acoustic energy on the interface of the focal zone extender and air will be enough for cavitation to take place, an atomisation of the liquid will occur. The width of the particle size spectrum in this case will be very wide by comparison with atomisation through the mesh. The focal zone extender can be used in any configuration of atomisers with or without mesh or other devices when it is required to maintain the level of liquid on the top of established level.

It is important to note that the liquid in this invention is acoustically active and performs two functions: one is to force liquid to pass through the mesh; the other is to apply the acoustic energy to the mesh thus forcing it to vibrate with the frequency of acoustical oscillator.

When the resonance frequency of the mesh is equal to that of acoustical oscillator then the atomisation efficacy improves significantly. This condition is technically simpler to achieve at higher frequencies when thickness of piezoceramic transducers, traditionally used for such oscillators, is of the same order of the thickness as the mesh.

Thus the outlined feature of atomisation with focused ultrasonic allows noticeably increase the rate of delivery by the way of significant increasing acoustical pressure and the amplitude of vibrations.

Due the fact that the focus ultrasonic radiation generally accompanies by substantial acoustic flow & radiation pressure, sonocapillary effect etc. ultrasonic cleaning of the mesh also occurs during the atomisation.

This is the great advantage of this technology. All available mesh nebulizers have a significant problem with cleaning and disinfection that limited its use for home applications and focused to ambulatory patient. [L. Vecelio, "The mesh nebuliser: a recent technical innovation for aerosol delivery", INSERM U-618, IFR 135, Universite de Tours, 37032 Tours, France. vecellio@med.univ-tours.fr].

Figure 7:
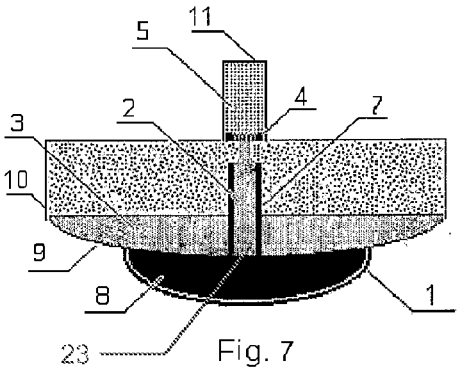
FIG. 7 is a concept atomiser layout for disinfection.

To perform the cleaning/disinfection process the liquid to be atomized should be chosen from the group of cleaning/disinfecting agents available for atomisation. To additionally enhance the efficiency of cleaning and to disinfect the atomiser it is possible to shift the mesh in upper part of the cavitation zone of the spout. This can be carried out by any means (not shown in the Fig), which can displace the mesh in order that the mesh surface is exposed to the ultrasonic radiation in the cavitation zone or in the adjacent to. In this case, due to the cavitation effect, part of the liquid will be atomized inside the atomisation chamber 10 below the mesh. To ensure the disinfection of this area above the mesh it should be covered by a lid 11 (FIG. 7). To carry out disinfection it is need setting up the gap between the side surface of the lid and the mesh one to allow the aerosol from chamber 10 to penetrate into the lid 11.

Figure 8:
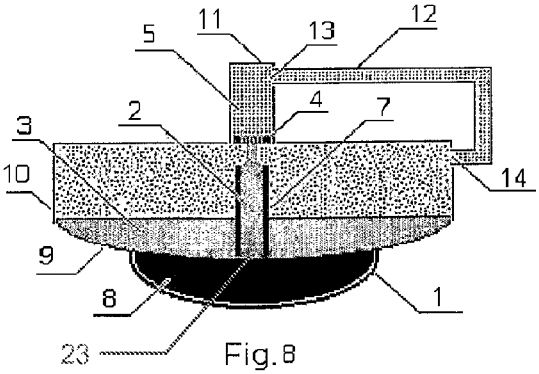
FIG. 8 is another concept atomiser for disinfection.
Figure 9:
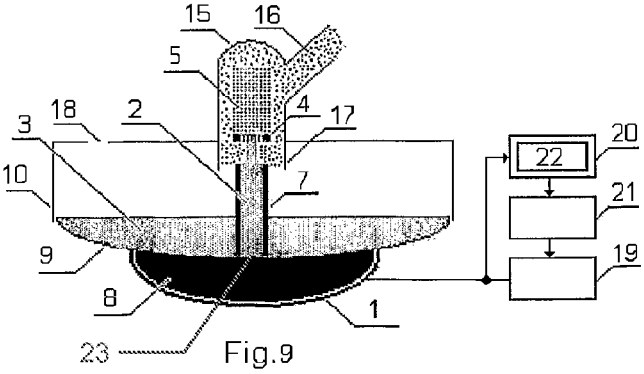
FIG. 9 is a dual atomisation concept.

To overcome possible excess of a disinfection agent, which could be created in some configuration of the atomisers in the area under the lid, a tube 12 is connected back to the atomisation chamber 10 through a hole 13 and 14 to allow aerosol condensation (FIG. 8). Alternatively, the hole 13 can be set as an outlet to the ambient air however in this case disinfectant will be released into the air.

This mode of operation is dedicated only for intensive cleaning/disinfection of the device but not for normal aerosol production.

Described above methods of cleaning and disinfection can be apply to any configuration of the apparatus with and without the focal zone extender.

A further advantage of the technology is that a gap between ultrasonic transducer and mesh is very large. It makes negligible the clogging effect with impurities particles, therefore for most applications clogging should not need to be taken into account.

As described above, atomizing apparatus can also be used for fuel atomisation, liquid purification, disinfection or sterilization depending on the size of the hole in the mesh. All foreign particles including bacteria, etc that approach the mesh inlet will not come through the mesh if their sizes exceed the size of the holes. However liquid will be able to pass through the mesh by atomisation.

The outlined new mesh atomiser combines the features of both static and vibrating mesh as well as dynamic of the acoustical jet technologies. It opens the new class of atomisation mesh technique, which I name as Dynamic Mesh Technology.

Based on the principle of the Dynamic Mesh technology a new type atomiser (FIG. 9) can be built. This device combines the property of the atomisation both in the spout and through the mesh. In this atomizer the mesh is shift to the upper part of the cavitation zone or in the adjacent to in order to expose the mesh surface to the ultrasonic radiation in this area. In this configuration atomisation chamber will consists of two sections 10 and 15. The section 15 covers up the aerosol production zone. In the configuration presented in FIG. 9 aerosol, produced from the moving spout due the cavitation, acquires the kinetic energy of the spout and travel to the outlet 16 together with the aerosol, which produced through the mesh. Aerosol motion from bottom 17 of the section 15 to the outlet 16 creates a negative pressure into the bottom area. To eliminate a negative effect of this pressure the hole 18 was made in the atomisation chamber. To control the particle size distribution into section 15 and/or outlet 16 could be mounted baffle/baffles.

It was found that changes in liquid level cause the resonance frequency of the acoustical transducer to shift out of resonance with the electronic oscillator 19 (FIG. 9), resulting in reduced atomization. To maintain the resonance, automatic frequency control (AFC) is implemented, using as a reference a signal proportional to the cavitation energy spectra. The reference signal could be for example a set of particular harmonics, or a part, or the whole acoustic cavitation spectra integrated.

The reference signal is picked up by any acoustically sensitive means designated generally as 22, for example, a microphone. In the atomizer presented in FIG. 9 the concave transducer 1, which carries out the functions of the transmitter as well the receiver, picks up the reference signal.

This reference signal is fed through an electric filter 20 and detector 21 to the AFC, which is an inherent part of the electronic oscillator 19 thus shifting its frequency and maintaining the resonance. If the functions of the transmitter and the receiver are performed by the same transducer (as in FIG. 9) the passband of the filter has to be distant or distinct from the spectra of the excitation signal of the electronic oscillator 19. Because the reference signal is proportional only to the modulus of the cavitation energy, information about the phase characteristics of the acoustic transducer is not required for AFC.

In conventional AFC for atomizers as a reference signal is used which is proportional to the active component of the acoustic resistance of the transducer. Separation of this active component requires compensation of the reactance component of the acoustic resistance during operation. This is a complicated phase task especially at high frequency.

Although the invention has been described with reference to specific examples, it will be appreciated by those skilled in the art from reading thereof that the invention can be embodied in other forms without departing from the scope of the concept herein disclosed.

The invention claimed is:

1. An atomization apparatus comprising: a container for holding a liquid to be atomized; a concave ultrasonic transducer operatively coupled to the container for transmission of acoustical energy to the liquid to be atomized at a focal zone to produce an acoustically active liquid; an electronic oscillator operatively coupled to the concave transducer to drive said transducer; a focal zone extender with a lower end disposed to be submerged below a surface of the liquid held in the container, the lower end having an inlet opening substantially at the focal zone, such that, in operation, a continuous column of the acoustically active liquid extends in non-atomized form throughout the full length of the focal zone extender so as to fill the focal zone extender; and an ultrasonic atomizing mesh disposed adjacent an upper end of the focal zone extender to contact at least part of the continuous column of acoustically active non-atomized liquid that exits the focal zone extender, whereby the atomizing mesh is vibrated, at ultrasonic frequency, principally by acoustical energy of the acoustically active non-atomized liquid such that the vibration of the atomizing mesh forces non-atomized liquid of the continuous column through the atomizing mesh so as to be emitted from a top surface of the atomizing mesh in atomized form.

2. An atomization apparatus as claimed in claim 1, wherein the resonance frequency of the mesh is substantially the same as that of the transducer.

3. An atomization apparatus as claimed in claim 1, wherein the focal zone extender includes a tube.

4. An atomization apparatus as claimed in claim 3, wherein the concave transducer generates a spout of said liquid.

5. An atomization apparatus as claimed in claim 4, wherein the tube forms a shroud about the column of liquid with a distal end of the tube being acoustically coupled to the mesh via a distal region of the spout.

6. An atomization apparatus as claimed in claim 5, wherein the distal end of the tube is acoustically coupled to the liquid spout at a position where the acoustical energy exceeds a threshold energy required to emit the liquid through the mesh.

7. An atomization apparatus as claimed in claim 1, further comprising a compartment connected to the container and being adapted to contain an acoustical transmission medium being separated from the liquid to be atomized by the container which is constructed of an acoustically transparent material.

8. An atomization apparatus as claimed in claim 1, further comprising an electric filter operatively coupled between an acoustically sensitive means and a detector, the electric filter designed to filter a reference signal having a frequency distinct from an acoustic signal frequency spectra of an excitation signal of the concave transducer, the detector having an output which is coupled to the electronic oscillator which receives the reference signal from the electric filter for automatic frequency control.

9. An atomization apparatus as claimed in claim 1, wherein the atomization mesh is disposed on a top of the focal zone extender.

10. An atomization apparatus as claimed in claim 1, wherein the atomization mesh is spaced above a top of the focal zone extender.

11. An apparatus for producing an aerosol from a liquid to be atomized, comprising:

a container holding a liquid to be atomized;

a source of focused ultrasonic energy configured to transmit said ultrasonic energy to said liquid and generate a flow of acoustically active liquid;

an aerosol-forming mesh enclosed in a tubular girdle partly submerged below a surface of the liquid held in the container, said mesh being below the surface of the liquid and remote from said source of ultrasonic energy, the mesh being arranged substantially at a focal zone of the ultrasonic energy to be vibrated principally by acoustic energy applied thereto by said acoustically active liquid at sufficient acoustic pressure to pass through the mesh and be atomized, the atomized liquid being ejected upwardly from the mesh and through the girdle.

12. An apparatus as claimed in claim 11, further comprising a compartment connected to the container and being adapted to contain an acoustical transmission medium being separated from the liquid to be atomized by the container which is constructed of an acoustically transparent material.

13. An atomization apparatus comprising:

a container for holding a liquid to be atomized;

a concave transducer operatively coupled to the container for transmission of acoustical energy to the liquid to be atomized at a focal zone to produce an acoustically active liquid;

an electronic oscillator operatively coupled to the concave transducer to drive said transducer;

a focal zone extender with a lower end disposed to be submerged below a surface of the liquid held in the container, the lower end having an inlet opening substantially at the focal zone, such that, in operation, a continuous column of the acoustically active liquid extends in non-atomized form throughout the full length of the focal zone extender so as to fill the focal zone extender; and an atomizing mesh disposed adjacent an upper end of the focal zone extender to contact at least part of the continuous column of acoustically active non-atomized liquid, whereby the mesh is vibrated principally by acoustical energy of the acoustically active non-atomized liquid such that the vibration of the mesh forces non-atomized liquid of the continuous column through the mesh so as to atomize the non-atomized liquid, wherein the atomization mesh is spaced above a top of the focal zone extender.

* * * * *